US010369678B2

(12) United States Patent
Dang et al.

(10) Patent No.: US 10,369,678 B2
(45) Date of Patent: Aug. 6, 2019

(54) FRAME, AND ABRADING SYSTEM, AND A METHOD FOR USING THE SAME

(71) Applicant: The Boeing Company, Chicago, IL (US)

(72) Inventors: Tho N. Dang, Lynnwood, WA (US); Sarah E. Dickerson, Bothell, WA (US)

(73) Assignee: The Boeing Company, Chicago, IL (US)

( * ) Notice: Subject to any disclaimer, the term of this patent is extended or adjusted under 35 U.S.C. 154(b) by 140 days.

(21) Appl. No.: 15/708,912

(22) Filed: Sep. 19, 2017

(65) Prior Publication Data

US 2019/0084123 A1 Mar. 21, 2019

(51) Int. Cl.
*B24B 41/02* (2006.01)
*B24B 1/04* (2006.01)
*B24D 11/02* (2006.01)

(52) U.S. Cl.
CPC ..... *B24B 41/02* (2013.01); *B24B 1/04* (2013.01); *B24D 11/02* (2013.01)

(58) Field of Classification Search
CPC ..... B24B 13/012; B24B 41/02; B24B 1/04; B24D 15/04; B24D 11/02
USPC ..... 451/59, 495, 514
See application file for complete search history.

(56) References Cited

U.S. PATENT DOCUMENTS 2,435,335 A * 2/1948 Andrews ..... B24D 15/026 451/493
3,123,947 A * 3/1964 Rawley ..... B24D 15/04 15/235.8
3,149,443 A * 9/1964 Engels ..... B24D 13/142 451/514
3,710,467 A * 1/1973 Coon ..... B23D 71/00 407/29.11
4,084,356 A * 4/1978 Brears ..... B24B 21/00 144/355
5,700,187 A * 12/1997 Balbi ..... B24D 15/04 451/495
7,131,902 B2 11/2006 Hope
8,210,909 B2 7/2012 Bernardi et al.
8,469,775 B2 * 6/2013 Dow ..... B24B 7/184 451/344
8,517,804 B2 * 8/2013 Weigmann ..... B24B 21/02 451/303
8,696,413 B2 * 4/2014 King, Jr. ..... B24D 15/04 451/344
9,833,871 B2 * 12/2017 Froněk ..... B24B 23/04
2002/0025770 A1 * 2/2002 Carlson ..... B24D 15/04 451/514
2002/0086627 A1 7/2002 Andrews et al.
2007/0037494 A1 * 2/2007 Cybulski ..... B24D 15/023 451/59
2010/0261414 A1 10/2010 Fronek
2013/0109284 A1 * 5/2013 Andonian ..... B24D 15/023 451/495
2013/0331009 A1 12/2013 King, Jr. et al.

* cited by examiner

*Primary Examiner* — George B Nguyen
(74) *Attorney, Agent, or Firm* — Coats + Bennett, PLLC

(57) ABSTRACT

A frame and/or an abrading system that is suitable for abrasion operations, and related methods of use. The frame includes articulating assemblies configured to change a curvature of their respective curved surfaces to correspond to a curvature of a curved surface of a workpiece, in response to relative displacement of a center plate of the frame toward a mounting plate of the frame.

20 Claims, 9 Drawing Sheets

FRAME, AND ABRADING SYSTEM, AND A METHOD FOR USING THE SAME

TECHNOLOGICAL FIELD

The present disclosure relates generally to the field of manufacturing and/or maintenance and rework tools and processes. More specifically, the present disclosure relates to a frame, an abrading system, and a method for using the same that is suitable for manufacturing and/or maintenance and rework.

BACKGROUND

Composite structures are used in a wide variety of applications. In aircraft construction, composites are used in increasing quantities to form the fuselage, wings, tail section, and other components. For example, the wings may be constructed of composite skin members to which stiffening elements, such as stringers, may be coupled to increase the bending strength and stiffness of the skin member. The stringers may extend in a generally span wise direction along the wing, i.e., approximately from the wing root to approximately the wing tip. The stringers may be bonded to the skin members.

The stringers in a wing may extend from an inboard section of the wing to an outboard section of the wing. The stringers may include purely structural stringers and also stringers that serve both a structural and a systemic purpose, such as vent stringers. Vent stringers may act as a conduit for venting fuel and fuel vapors from the inboard section of the wing fuel tanks to the surge tanks farther out in the wings. The vent stringers may carry fuel or fuel vapors during refueling or during flight operation of the aircraft, when pressure changes may require venting of the fuel aircraft tanks.

The manufacturing of composite components, particularly for aircraft, typically involves abrading an external surface of a partially complete composite component, so that subsequent layers, such as sealing layers, and/or other components, may form better bonds with the exterior surface. Additionally or alternatively, the external surface of a complete composite component may be abraded so that other components may form better bonds with the exterior surface. The abrading of the surface may be carried out, for instance, using a conventional sheet of sand paper. However, alternative abrading techniques and equipment can help decrease processing time and associated costs.

SUMMARY

Aspects of the present disclosure are directed to a frame and/or an abrading system that is suitable for manufacturing and/or maintenance and rework of various types of components, for example, aircraft and aircraft components. A further aspect of the disclosure is directed to a method of abrading an exterior surface that is suitable for manufacturing and/or maintenance and rework of various types of components, for example, aircraft and aircraft components.

Aspects of the present disclosure are directed to a frame for an abrading system configured to abrade an exterior surface of a workpiece. At least a portion of the exterior surface of the workpiece is a curved section having a curvature. The frame comprises a mounting plate, a center plate, a first articulating assembly, and a second articulating assembly. The mounting plate has a first end portion and a second end portion opposite the first end portion. The center plate has a first end portion and a second end portion opposite the first end portion. The first articulating assembly is coupled to the mounting plate first end portion and the center plate first end portion, and defines a first curved surface. The second articulating assembly is coupled to the mounting plate second end portion and the center plate second end portion, and define a second curved surface. Each of the first and second articulating assemblies are configured to change a curvature of their respective curved surfaces to correspond to the curvature of the curved section of the workpiece, in response to relative displacement of the center plate toward the mounting plate.

In further aspects, the frame further comprises a biasing mechanism coupled to the mounting plate and the center plate and configured to bias the mounting plate and the center plate apart. In some aspects, the biasing mechanism comprises a plurality of biasing posts that inhibit relative lateral movement between the mounting plate and the center plate. In some aspects, each biasing post comprises an outer member, an inner member positioned at least partially within the outer member, and a spring housed within the outer member and the inner member.

In further aspects, the first and second end portions of the mounting plate are downwardly extending; the mounting plate further comprises a central zone disposed between the first and second end portions; the first articulating assembly connects to the mounting plate at the first end portion of the mounting plate; and the second articulating assembly connects to the mounting plate at the second end portion of the mounting plate. In some aspects, the mounting plate circumscribes an arc of at least 180° from a distal tip of the first end portion to a distal tip of the second end portion.

In another aspect, each of the first and second articulating assemblies comprises a plurality of links hinged together in series, and the plurality of links are each rigid. In some aspects, adjacent ones of the links of the first articulating assembly are pivotally interconnected for relative rotation about a corresponding pivot axis; and adjacent ones of the links of the second articulating assembly are pivotally interconnected for relative rotation about a corresponding pivot axis. In some aspects, the links of each of the first and second articulating assemblies include respective stops that limit relative rotation of adjacent links so that: a) a distance between the mounting plate and the center plate remains below a predefined maximum distance when the center plate is not being forced toward the mounting plate; b) a first intermediate link of the plurality of links of the first articulating assembly extends below the center plate; and c) a second intermediate link of the plurality of links of the second articulating assembly extends below the center plate. In some aspects, the first articulating assembly comprises a first intermediate link; with the first intermediate link being non-linear; with the first intermediate link comprising a first portion and a second portion that extends transversely to the first portion; and the second articulating assembly comprises a second intermediate link, with the second intermediate link being non-linear; with the second intermediate link comprising a first portion and a second portion that extends transversely to the first portion.

In further aspects, the center plate is planar.

Aspects of the present disclosure are also directed to an abrading system for abrading a surface of a workpiece. At least a portion of the surface of the workpiece is a curved section having a curvature. The abrading system comprises: a first abrasion pad and a frame. The first abrasion pad has a first surface and an opposite abrasion surface. The frame has a mounting plate, a center plate, a first articulating assembly, and a second articulating assembly. The mounting plate has a first end portion and a second end portion opposite the first end portion. The center plate has a first end portion and a second end portion opposite the first end portion. The first articulating assembly is coupled to the mounting plate first end portion and the center plate first end portion, and defines a first curved surface. The second articulating assembly is coupled to the mounting plate second end portion and the center plate second end portion, and defines a second curved surface. Each of the first and second articulating assemblies are configured to change a curvature of their respective curved surfaces to correspond to the curvature of the curved section of the workpiece, in response to relative displacement of the center plate toward the mounting plate. The first surface of the abrasion pad is mounted to the center plate and the first and second curved surfaces.

In further aspects, the abrading system further comprises a vibration source operatively coupled to the mounting plate. In some aspects, the vibration source is an orbital sander.

In another aspect, the frame further comprises a biasing mechanism coupled to the mounting plate and the center plate that is configured to bias the mounting plate and the center plate apart.

Aspects of the present disclosure are directed to a method of abrading an exterior surface of a workpiece using an abrading system. At least a portion of the exterior surface of the workpiece is a curved section having a curvature. The abrading system includes a frame and a first abrasion pad coupled to the frame. The first abrasion pad has an abrasion surface. The frame comprises: a mounting plate; a center plate, a first articulating assembly, and a second articulating assembly. The mounting plate has a first end portion and a second end portion opposite the first end portion. The center plate has a first end portion and a second end portion opposite the first end portion. The first articulating assembly is coupled to the mounting plate first end portion and the center plate first end portion, and defines a first curved surface. The second articulating assembly is coupled to the mounting plate second end portion and the center plate second end portion, and defines a second curved surface. The first abrasion pad is mounted to the center plate and at least part of each of the first and second curved surfaces of the first and second articulating assemblies so that the abrasion surface of the abrasion pad faces away from the mounting plate. The method comprises changing a curvature of the curved surfaces of the first and second articulating assemblies to correspond to the curvature of the curved section of the workpiece by pressing the abrasion surface against the workpiece so as to displace the mounting plate toward the center plate. The method also comprises moving, while the curvature of the curved surfaces of the first and second articulating assemblies correspond to the curvature of the curved section of the workpiece, the abrading system along a longitudinal axis of the workpiece so as to abrade the surface of the workpiece.

In further aspects, the method further comprises attaching a vibration source to the mounting plate, with the moving the abrading system along the workpiece along the longitudinal axis of the workpiece comprising vibrating the frame using the vibration source while moving the abrading system along the workpiece.

In further aspects, the abrasion surface is curved downwardly convex with the center plate not urged toward the mounting plate, and the changing the curvature comprises decreasing a radius of curvature of the curved surfaces of the first and second articulating assemblies.

In further aspects, the changing the curvature comprises displacing the center plate toward the mounting plate against a biasing mechanism that urges the center plate away from the mounting plate.

In further aspects, the method further comprises replacing the abrasion surface by removing the first abrasion pad from the frame and attaching a second abrasion pad to the frame in place of the first abrasion pad.

The features, functions and advantages that have been discussed can be achieved independently in various aspects or may be combined in yet other aspects further details of which can be seen with reference to the following description and the drawings.

BRIEF DESCRIPTION OF THE DRAWINGS

Having thus described variations of the disclosure in general terms, reference will now be made to the accompanying drawings, which are not necessarily drawn to scale.

Figure 1:
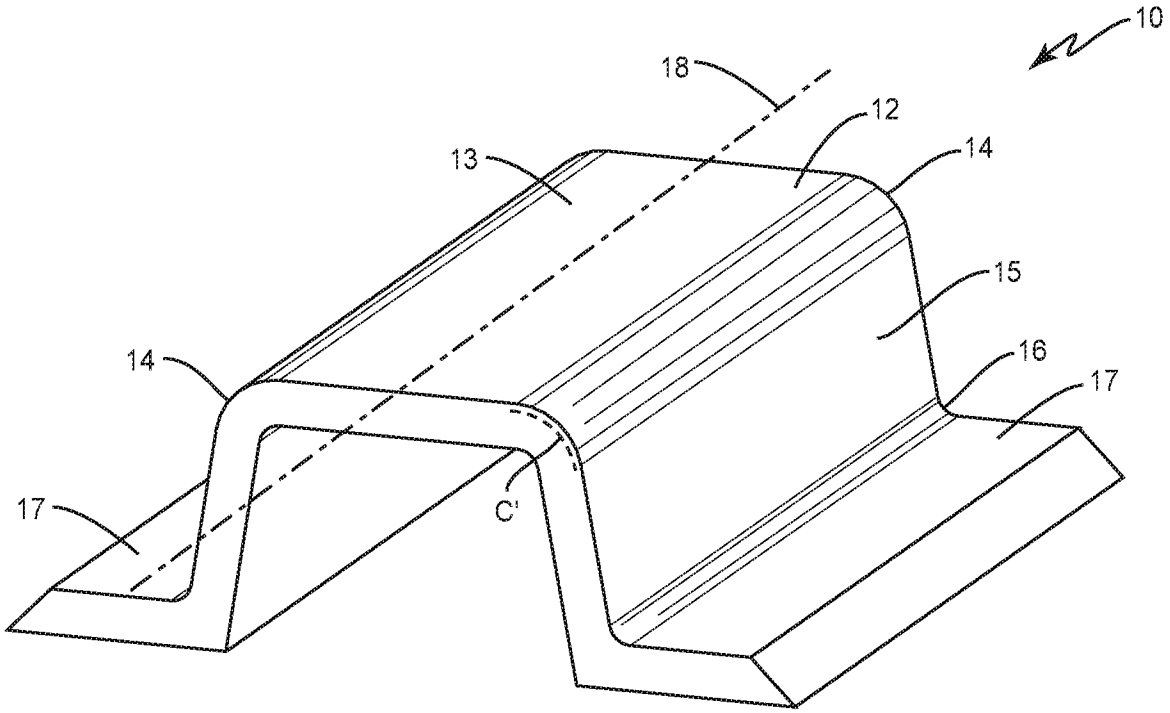

FIG. 1 shows a perspective view of an exemplary workpiece that can be worked on by an abrading system of aspects of the present disclosure.

Figure 2:
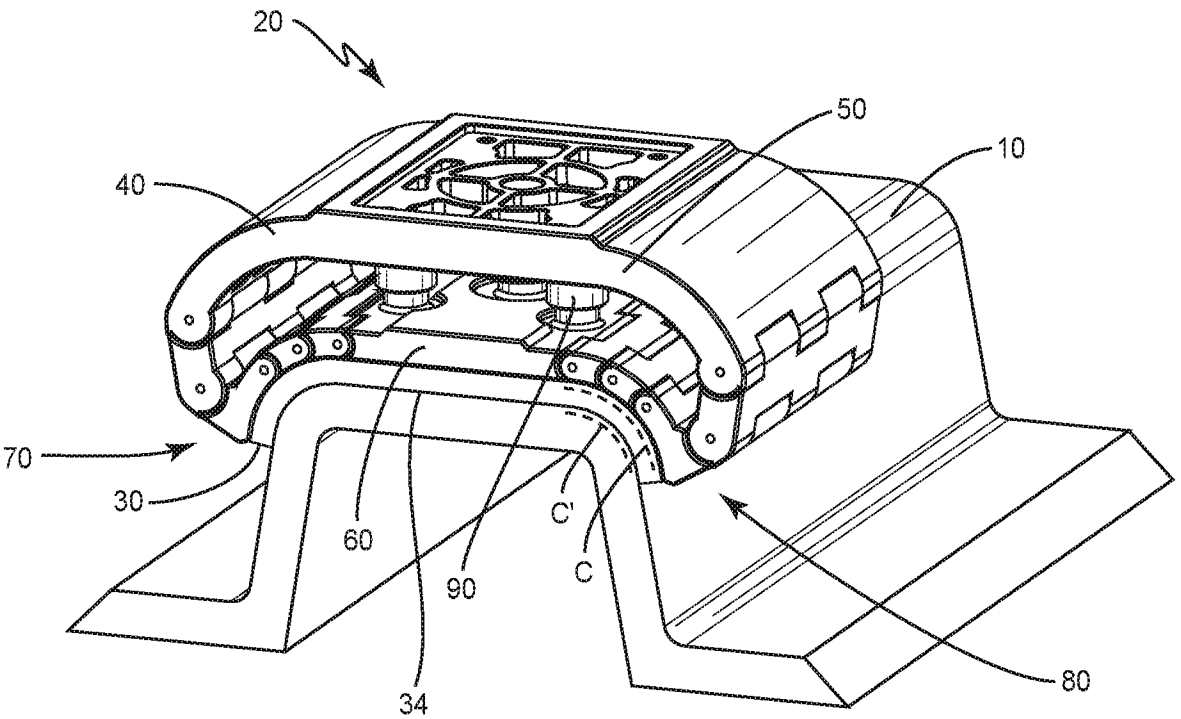

FIG. 2. shows a perspective view of an abrading system of aspects of the present disclosure, with the workpiece of FIG. 1.

Figure 3:
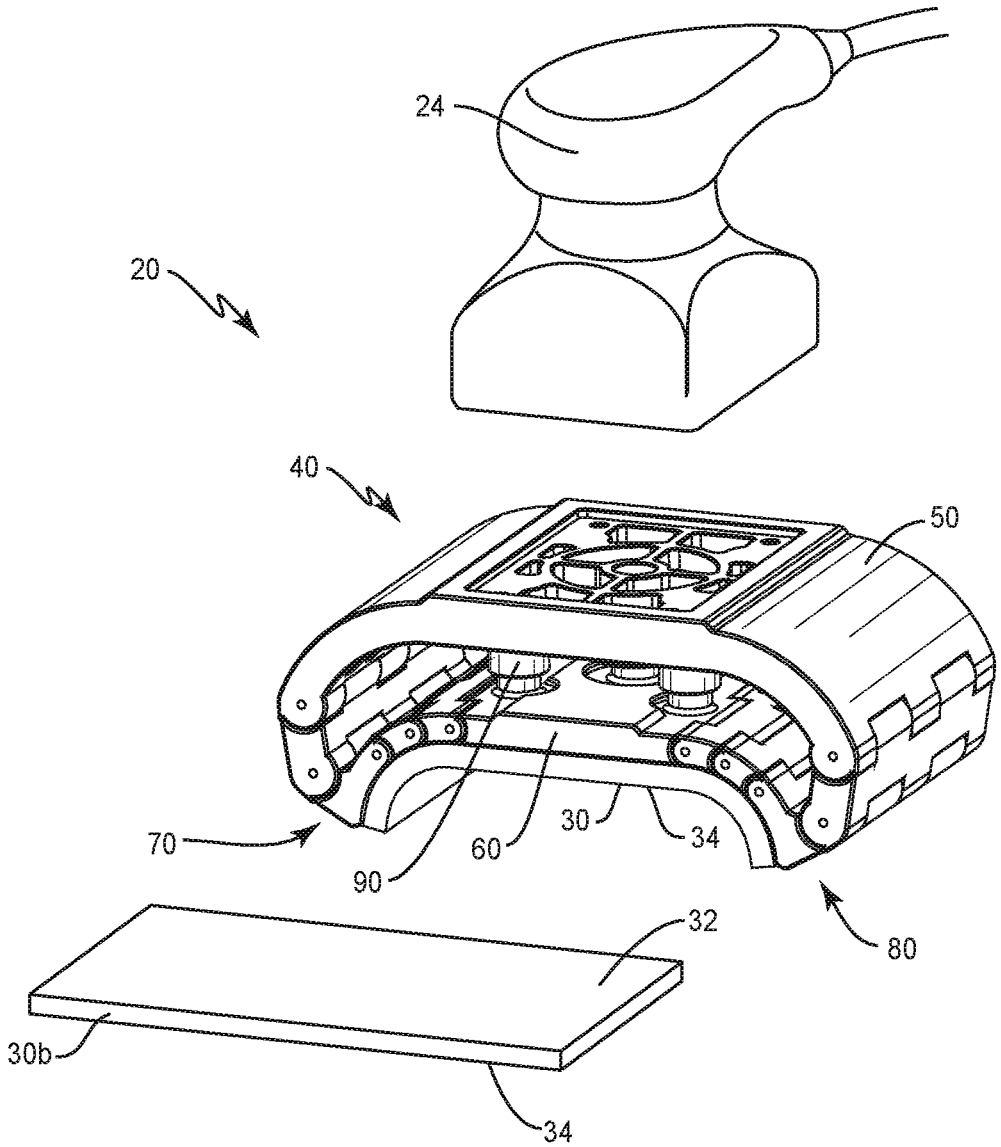

FIG. 3 shows a partially exploded view of an abrading system of aspects of the present disclosure.

Figure 4:
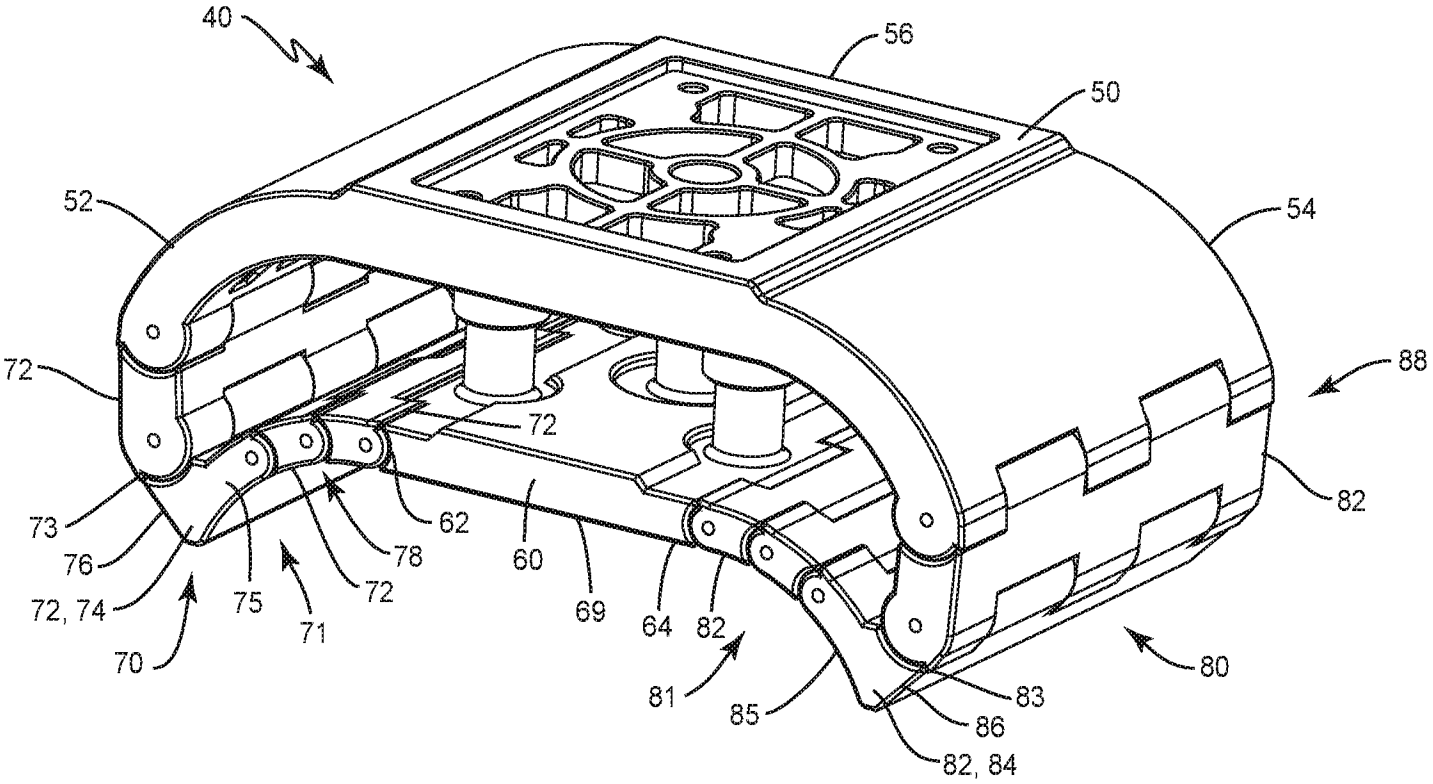

FIG. 4 shows a perspective view of a frame of aspects of the present disclosure.

Figure 5:
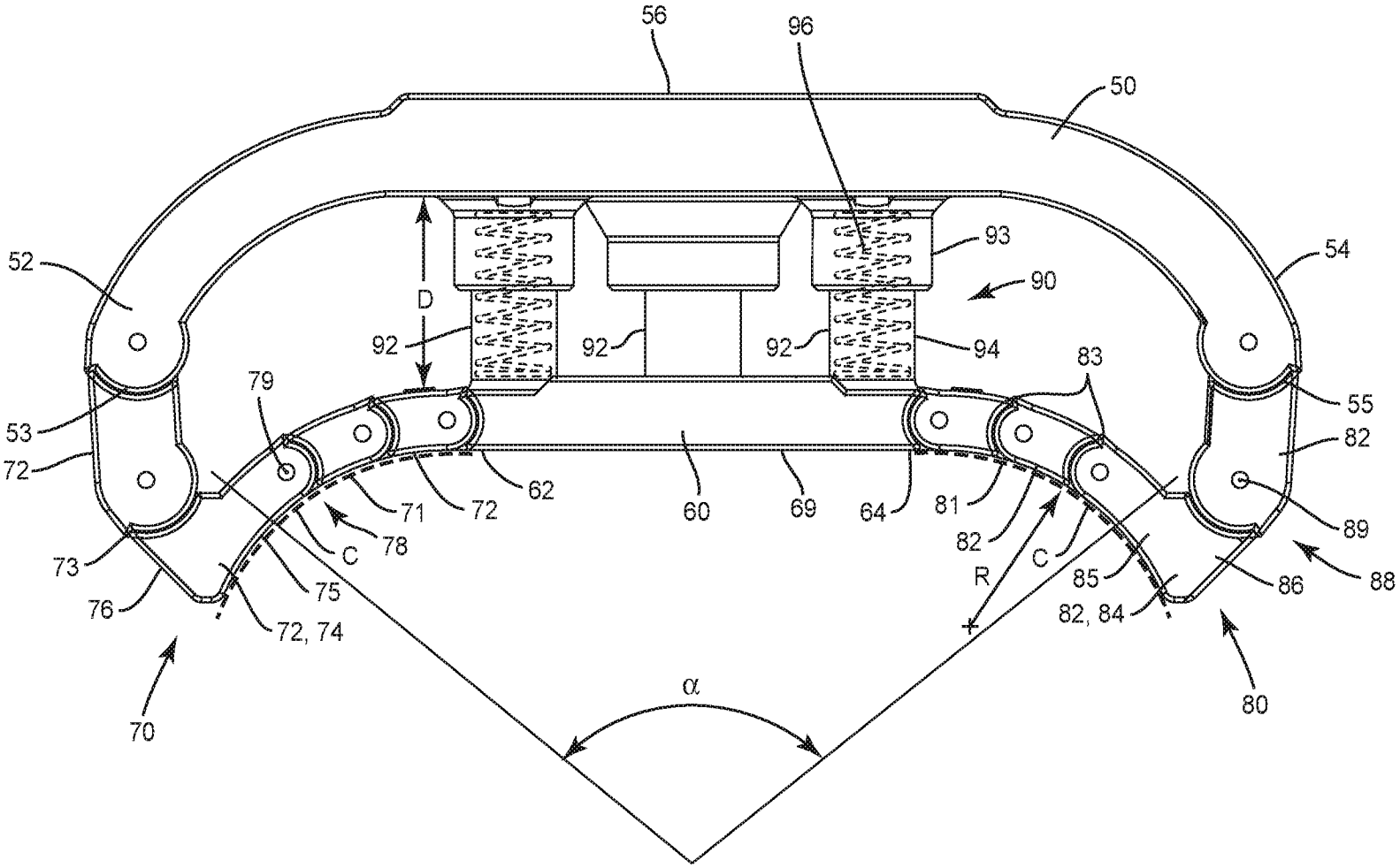

FIG. 5 shows a front view of the frame of FIG. 4, in a first configuration.

Figure 6:
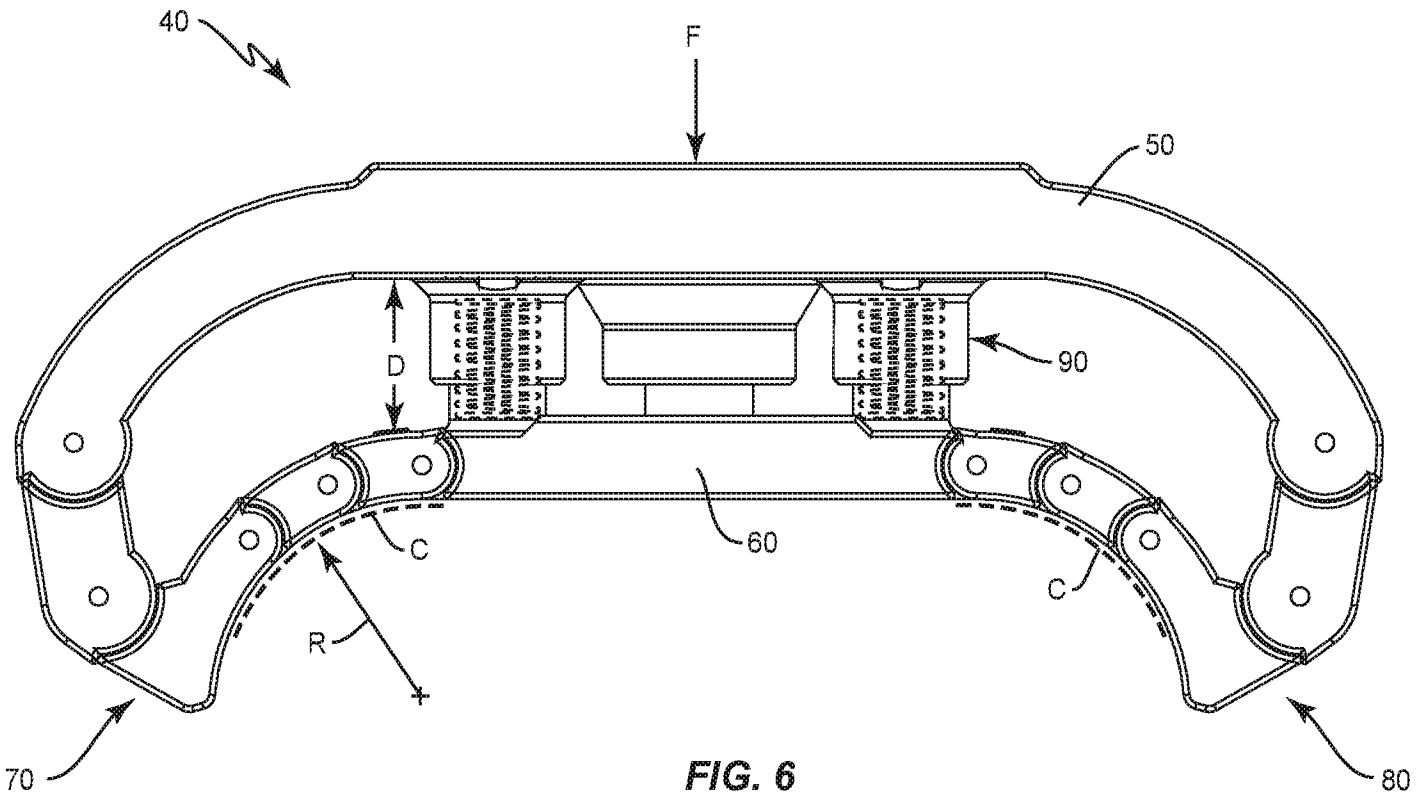

FIG. 6 shows a front view of the frame of FIG. 4, in a second configuration.

Figure 7:
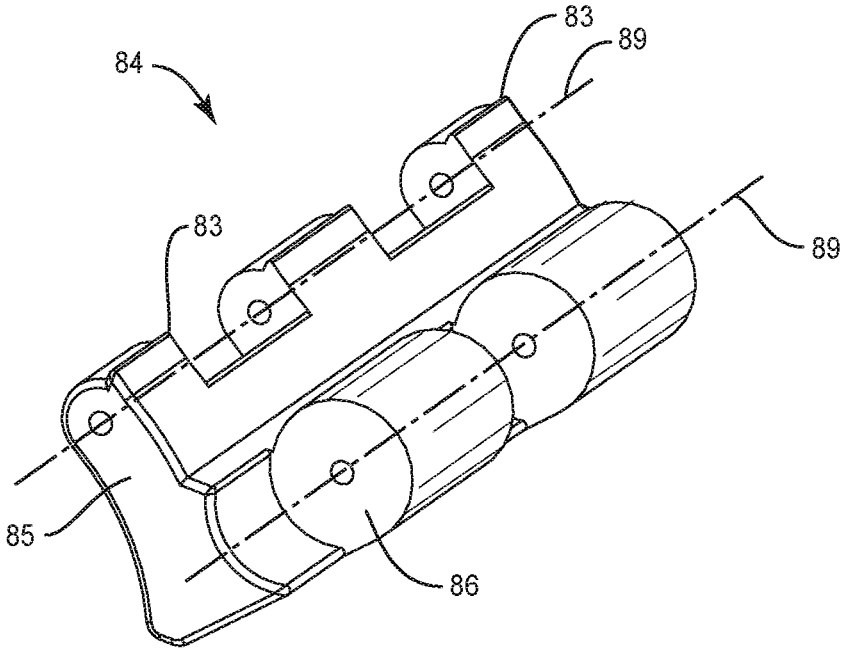

FIG. 7 shows a more detailed view of a portion of the frame of FIG. 4.

Figure 8:
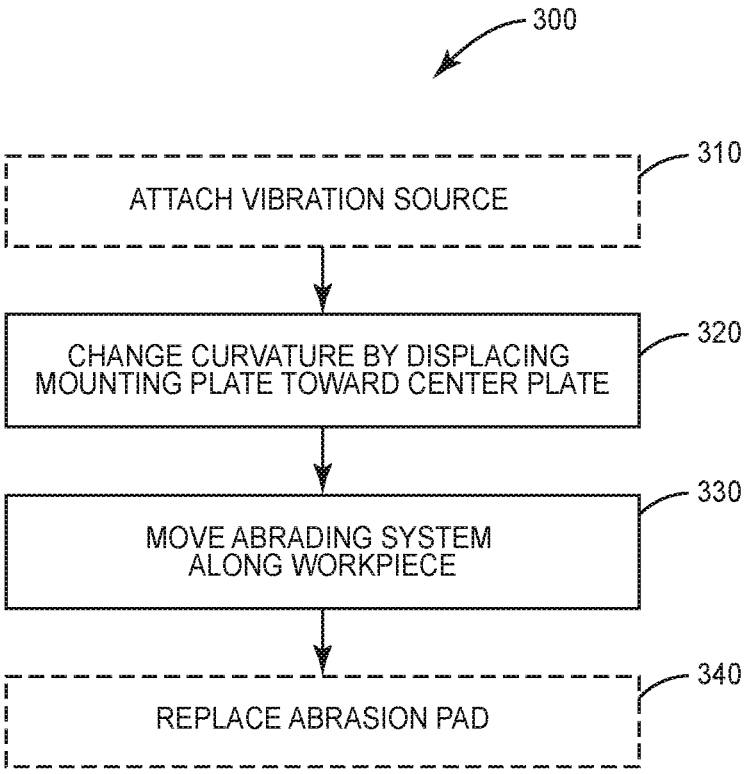

FIG. 8 shows a flowchart pertaining to aspects of the present disclosure.

Figure 9:
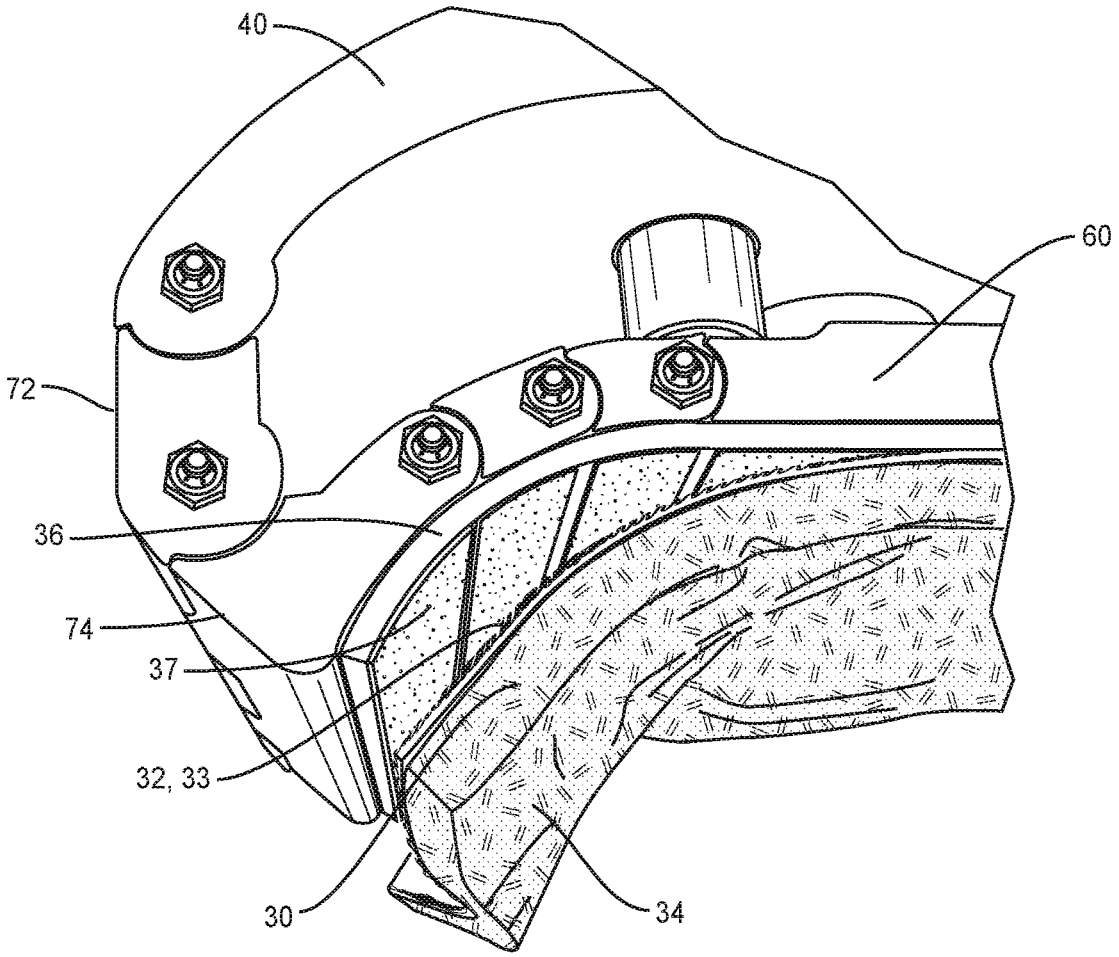

FIG. 9 shows a partial perspective view of an abrading system of aspects of the present disclosure.

DETAILED DESCRIPTION

Aspects of the present disclosure are directed to a frame 40 and/or an abrading system 20, and method 300 of use of the same, that are suitable for manufacturing and/or maintenance and rework of various types of components. According to some aspects, a frame 40 is disclosed that has a mounting plate 50 and a center plate 60 that are connected by articulating assemblies 70 and 80. The articulating assemblies 70 and 80 are configured to change a curvature C of respective curved surfaces 71 and 81 of the frame 40 to correspond to a curved surface of a workpiece. With an abrasion pad 30 attached to the curved surfaces 71 and 81 of the frame 40, the abrasion pad 30 is urged to conform to the curved surface of the workpiece. In some aspects, this allows an exterior surface of the workpiece that includes at least a portion having a curvature to be abraded efficiently.

FIG. 1 shows a perspective view of an exemplary workpiece 10 that can be worked on by the abrading system 20(*s*) of the present disclosure. The workpiece 10 of FIG. 1 has an exterior surface 12 that, in cross-section, includes a center section 13, curved sections 14, flank sections 15, lower corner sections 16, and base sections 17. The center section 13 is generally flat and defines an upper portion of the workpiece 10, the flank sections 15 are generally flat, and the base sections 17 are generally flat. The curved sections 14 have a curvature C' such that portions of the curved sections 14 lie outside a theoretical plane defined by the center section 13. Thus, the workpiece 10 of FIG. 1 has an exterior surface 12 that has at least a portion thereof that has a curvature C'. In the illustrated workpiece 10, the upper center section 13 is laterally bounded on both left and right sides by a curved section 14. Because the exterior surface 12 of the workpiece 10 includes at least one curved section 14 and at least one portion having a different shape, e.g., the flat center section 13, the exterior surface 12 of the workpiece 10 of FIG. 1 is one example of a workpiece 10 having a complex exterior surface. The workpiece 10 has a longitudinal axis 18. In some aspects, the length of the workpiece 10 along the workpiece's longitudinal axis 18 is relatively long compared to a cross-sectional width of the workpiece 10, such as being 50-100 feet (ft.) (15-30 meters (m.)) long, or more. In other examples, the workpiece 10 is longer or shorter, and/or of different cross-sectional shapes and/or dimensions. It should be understood that while the workpiece 10 of FIG. 1 is illustrative of some workpieces that may be used with aspects of the present disclosure, the workpiece 10 may have any suitable shape, especially a shape with at least one curved surface. Thus, while the workpiece 10 of FIG. 1 is an example of a vent type stringer for a vehicle, the disclosure is not limited to such vent type stringers for vehicles, and is applicable to use with various workpieces having an exterior surface 12 that includes at least a portion that has a curvature C'.

The abrading system 20 is configured to abrade exterior surface 12 of workpiece 10, with at least a portion of the exterior surface 12 being a curved section 14 that has a curvature C'. An exemplary abrading system 20 is shown in FIG. 2 and FIG. 3. The abrading system 20 of FIG. 2 generally includes a frame 40 and an abrasion pad 30. The frame 40 is discussed further below. The abrasion pad 30 includes a first surface 32 oriented toward the frame 40, and an abrasion surface 34 that is oriented away from the frame 40. The abrasion surface 34 includes an abrasion material. The abrasion pad 30, in an example, is sandpaper. In another example, the abrasion pad 30 is a thicker pad and includes, for example, a SCOTCH-BRITE brand abrasive scouring pad available from 3M Company of St. Paul, Minn. ("SCOTCH-BRITE" is a registered trademark of 3M Company of St. Paul, Minn.). In some aspects, the abrasion pad 30 may be directly mounted to the frame 40. In other aspects, the abrasion pad 30 may be mounted to the frame 40 via an intervening cushion layer 36 (see FIG. 9).

The abrasion pad 30 is removably mountable to the frame 40. In some examples, the abrasion pad 30 is removably mounted to the frame 40 using a hook-and-loop fastener connection. For example, as shown in FIG. 9, a hook portion 37 of a hook-and-loop fastener connection may be arranged in parallel strips and secured to the frame 40 (such as lower surface 69 of the center plate 60 and the first curved surface 71 and second curved surface 81, discussed below) via a cushion layer 36; and the upper surface 32 of the abrasion pad 30 may have a loop portion 33 of a hook and loop fastener connection. The hook portion 37 releasably engages the loop portion 33 to removably mount the abrasion pad 30 to the frame 40. In some aspects, discussed further below, the abrading system 20 includes a vibration source 24 (see FIG. 3) and, in other aspects, the vibration source 24 is omitted (see FIG. 2). In some aspects, a replacement abrasion pad 30*b* is provided.

The abrading system 20 of FIG. 2 is shown in FIGS. 4-6, without the abrasion pad 30. The frame 40 of FIG. 4 generally includes a mounting plate 50, a center plate 60, a first articulating assembly 70, a second articulating assembly 80, and a biasing mechanism 90. As described in more detail herein, each of the first and second articulating assemblies 70 and 80 are configured to change curvature C of their respective curved surfaces 71 and 81 to correspond to the curvature C' of the curved surface 14 of the workpiece 10 in response to relative displacement of the center plate 60 toward the mounting plate 50.

The mounting plate 50 forms an upper portion of the frame 40. The mounting plate 50 includes a first end portion 52 and a second end portion 54. The mounting plate 50 extends from a distal tip 53 of the first end portion 52 (toward the left in FIGS. 4-6) to a distal tip 55 of the second end portion 54 (toward the right in FIGS. 4-6). A central zone 56 is disposed between the first end portion 52 and the second end portion 54. The central zone 56, in some aspects, is generally flat, but may be curved if desired. In an example, the central zone 56 includes a plurality of cutouts or other weight reduction features. The first end portion 52 and the second end portion 54 are disposed on opposing lateral sides of the central zone 56 and are downwardly curved, such that the mounting plate 50 sweeps an arc ($\alpha$) of about 180° or more. Thus, in some aspects, the mounting plate 50 circumscribes an arc ($\alpha$) of at least 180° from distal tip 53 of the first end portion 52 to the distal tip 55 of the second end portion 54. Thus, in some aspects, the distal tips 53 and 55 are downwardly facing. The first end portion 52 and the second end portion 54 may be referred to herein as lateral wings. In FIG. 2, the first end portion 52, the central zone 56, and the second end portion 54 are formed unitarily as a one-piece mounting plate 50. In some aspects, the first and second end portions 52 and 54 of the mounting plate 50 are downwardly extending; the mounting plate 50 has a central zone 56 disposed between the first and second end portions 52 and 54; the first articulating assembly 70, as discussed further below, connects to the mounting plate 50 at the first end portion 52 of the mounting plate 60; and the second articulating assembly 80, as discussed further below, connects to the mounting plate 50 at the second end portion 54 of the mounting plate 50.

The center plate 60 is disposed below the mounting plate 50. The center plate 60 includes a first end portion 62 and a second end portion 64. The mounting plate 50 overlaps the center plate 60 and is in spaced relation to the center plate 60. The center plate 60 extends from a first end portion 62 (toward the left in FIG. 4) to a second end portion 64 (toward the right in FIG. 4). In some aspects, the center plate 60 is planar. A lower surface 69 of the center plate 60 is oriented away from the mounting plate 50. The lower surface 69 forms an attachment surface, to which a portion of the abrasion pad 30 may be attached.

The first articulating assembly 70 is coupled to the mounting plate first end portion 52 and the center plate first end portion 62. The first articulating assembly 70 defines a first curved surface 71. The first articulating assembly 70 movably interconnects the first end portion 62 of the center plate 60 to the first end portion 52 of the mounting plate 50. The first articulating assembly 70 of FIG. 4 includes a plurality of links 72 that are interconnected in series. In some aspects, adjacent links 72 are pivotally interconnected via suitable hinge connections 78, such as hinge pins. Likewise, the endmost links 72 are pivotally interconnected to the corresponding first end portions 52 and 62 via suitable hinge connections 78. Thus, in some aspects, the links 72 are able to rotate relative to their adjacent components (i.e., another link 72 or mounting plate 50 or center plate 60), such as about a pivot axis 79 of the hinge connection 78 between the adjacent components, such that the first articulating assembly 70 is able to change shape. In some aspects, the links 72 and/or the end portions 52 and 62 include suitable stops 73 so that the range of relative rotation is limited, as explained further below.

In some aspects, the outer surface of some or all of the links 72 are curved, so that the first articulating assembly 70 can form a smoothly curving lower curved surface 71 that is concave and facing away from the mounting plate 50. The curvature C of the lower curved surface 71 is variable, depending on the shape of the first articulating assembly 70, which is changeable in shape. In some aspects, the links 72 include an intermediate link 74 that includes a first portion 75 that extends in a first direction, and a second portion 76 that extends in another direction transverse to the first direction. Thus, in some aspects, the intermediate link 74 is "L" shaped. Thus, in some aspects, the first articulating assembly 70 includes a first intermediate link 74, wherein the first intermediate link 74 is non-linear, wherein the first intermediate link 74 includes a first portion 75 and a second portion 76 that extends transversely to the first portion 75. In some aspects, the links 72, including intermediate link 74, are each rigid.

Thus, in some aspects, the first articulating assembly 70 includes a plurality of links 72 that are hinged together in series. In some aspects, adjacent ones of the links 72 of the first articulating assembly 70 are pivotally interconnected for relative rotation about a corresponding pivot axis 79.

The second articulating assembly 80 is coupled to the mounting plate second end portion 54 and the center plate second end portion 64. The second articulating assembly 80 defines a second curved surface 81. The second articulating assembly 80 movably interconnects the second end portion 64 of the center plate 60 to the second end portion 54 of the mounting plate 50. The second articulating assembly 80 of FIG. 4 includes a plurality of links 82 that are interconnected in series. In some aspects, adjacent links 82 are pivotally interconnected via suitable hinge connections 88, such as by hinge pins. Likewise, the endmost links 82 are pivotally interconnected to the corresponding second end portions 54 and 64 via suitable hinge connections 88. Thus, in some aspects, the links 82 are able to rotate relative to their adjacent components (i.e., another link 82, or mounting plate 50, or center plate 60), such as about a pivot axis 89 of the hinge connection 88 between the adjacent components, such that the second articulating assembly 80 is able to change shape. In some aspects, the links 82 and/or the end portions 54 and 64 include suitable stops 83 so that the range of relative rotation is limited, as explained further below.

In some aspects, the outer surface of some or all of the links 82 are curved, so that the second articulating assembly 80 can form a smoothly curving lower curved surface 81 that is concave and facing away from the mounting plate 50. The curvature C of the lower curved surface 81 is variable, depending on the shape of the second articulating assembly 80, which is changeable in shape. In some aspects, the links 82 include an intermediate link 84 that includes a first portion 85 that extends in a first direction, and a second portion 86 that extends in another direction transvers to the first direction. See FIG. 7. Thus, in some aspects, the intermediate link 84 is "L" shaped. Thus, in some aspects, the second articulating assembly 80 includes a second intermediate link 84, wherein the second intermediate link 84 is non-linear, wherein the second intermediate link 84 includes a first portion 85 and a second portion 86 that extends transversely to the first portion 85. In some aspects, the links 82, including intermediate link 84, are each rigid. In some aspects, the second articulating assembly 80 is a mirror image of the first articulating assembly 70.

Thus, in some aspects, the second articulating assembly 80 includes a plurality of links 82 that are hinged together in series. In some aspects, adjacent ones of the links 82 of the second articulating assembly 80 are pivotally interconnected for relative rotation about a corresponding pivot axis 89.

In some aspects, the center plate 60, the first articulating assembly 70, the center plate 60, and the second articulating assembly 80 connect in series to form a continuous loop.

The biasing mechanism 90 is coupled to the mounting plate 50 and the center plate 60. The biasing mechanism 90 is configured to bias the mounting plate 50 and the center plate 60 apart. The biasing mechanism 90 of the frame 40 of FIG. 3 includes a plurality of biasing posts 92 which are of variable height. In some aspects, each biasing post 92 includes a first member 93 (e.g., an outer member) and a second member 94 (e.g., an inner member) that engage telescopically. For a given biasing post 92, one of the second member 94 and the first member 93 extends downward from the mounting plate 50, and the other of the second member 94 and the first member 93 extends upward from the center plate 60. In some aspects, the biasing posts 92 are substantially identical, in other aspects the biasing posts 92 are not identical. In some aspects, all the first members 93 extend downward from the mounting plate 50, and all the second members 94 extend upward from the center plate 60. In some aspects, there are four main biasing posts 92 arranged in a generally rectangular pattern, and a central biasing post 92. In some aspects, the members 93 or 94 are formed unitarily as one piece with the mounting plate 50, and the other members 94 or 93 are formed unitarily as one piece with the center plate 60.

In some aspects, one or more of the biasing posts 92 have a compression spring 96 housed within the first member 93 and the second member 94, internal to the respective biasing post 92. The biasing mechanism 90 acts to urge the center plate 60 away from the mounting plate 50. In some aspects, the amount of bias or separation force is adjustable by adjusting the number and/or spring rate of one or more of the springs 96. Adjustment of the bias force helps allow the pressure of the abrasion pad 30 against the exterior surface 12 to be adjusted and/or balanced, as is desired. Thus, in some aspects, each biasing post 92 comprises a first member 93, a second member 94 (positioned at least partially within the first member 93), and a spring 96 housed within the first member 93 and the second member 94.

Note that the biasing posts 92 of the biasing mechanism 90, with or without springs 96, also act to inhibit relative lateral movement between the mounting plate 50 and the center plate 60. In some aspects, the biasing posts 92 of the biasing mechanism 90, with or without springs 96, also act to inhibit relative longitudinal movement between the mounting plate 50 and the center plate 60. In some aspects, there is no biasing mechanism 90.

The frame 40 is configured such that the distance D between the mounting plate 50 and the center plate 60 may be varied, and such that varying the distance D between the mounting plate 50 and the center plate 60 causes the curvature C of the first articulating assembly 70 and the second articulating assembly 80 to be varied. For example, if the center plate 60 is supported from underneath, applying a downward force F to the mounting plate 50 causes the mounting plate 50 to be displaced toward the center plate 60, against the bias of the biasing mechanism 90, if present. Thus, the distance D between the mounting plate 50 and the center plate 60 is decreased. As a result of this vertical relative displacement between the mounting plate 50 and the center plate 60, the first and second articulating assemblies 70 and 80 change their shape. By way of example, FIG. 5 shows the frame 40 in a first configuration corresponding to an unloaded condition, without the force F applied to the mounting plate 50. Applying the downward force F to the mounting plate 50 (while the center plate 60 is supported from underneath) causes the frame 40 to assume a second configuration corresponding to a loaded condition shown in FIG. 6.

As can be seen by comparing FIG. 5 to FIG. 6, the first and second articulating assemblies 70 and 80 change their shapes between the first configuration and the second configuration. In particular, the curvature C of the first and second curved surfaces 71 and 81 changes, with the curvature C being tighter or sharper in the loaded condition (second configuration). When the frame 40 is loaded by being pressed against a workpiece 10 having a curved exterior surface 12, each of the first and second articulating assemblies 70 and 80 change the curvature C of their respective curved surfaces 71 and 81 to correspond to the curvature C' of the curved surface of the workpiece 10 (e.g., curved sections 14). As can be appreciated, when an abrasion pad 30 is mounted to the underside of the center plate 60 and the nearby portions of the first and second articulating assemblies 70 and 80, changing the curvature C of the first and second articulating assemblies 70 and 80 causes the curvature of the abrasion pad 30 to also change, so as to likewise correspond to the curvature C' of the curved section 14 of the workpiece 10. In some aspects, the frame 40 and the abrading system 20 may be considered as self-adjusting to curved contours of the exterior surface 12 of the workpiece 10.

Lateral and longitudinal movement of the mounting plate 50 is conveyed to the center plate 60 via the first and second articulating assemblies 70 and 80. In addition, lateral and longitudinal displacement of the mounting plate 50 is conveyed to the center plate 60 by the biasing posts 92 of the biasing mechanism 90, which are configured to inhibit relative lateral movement between the mounting plate 50 and the center plate 60. In some aspects, a vibration source 24 is attached to the mounting plate 50, such as by being mounted to the upper surface of central zone 56 of mounting plate 50. In some aspects, the vibration source 24 is a powered sander, such as an orbital sander, that provides vibrational input to the mounting plate 50. The vibrational input, and the resulting lateral and/or longitudinal displacement of the mounting plate 50, is conveyed to the center plate 60 and the abrasion pad 30 via the first and second articulating assemblies 70 and 80 and the biasing posts 90 of the biasing mechanism 90.

An exemplary method of using an abrading system 20 of the present disclosure is shown in FIG. 8. The method 300 of FIG. 8 includes changing 320 a curvature C of the curved surfaces 71 and 81 of the first and second articulating assemblies 70 and 80 to correspond to the curvature C' of the curved sections 14 of the workpiece 10 by pressing the abrasion surface 34 against the workpiece 10 so as to displace the mounting plate 50 toward the center plate 60. The pressing of the abrasion surface 34 against the workpiece 10 is in response to manually and/or machine applied force F urging the mounting plate 50 of the frame 40 downward toward the center plate 60 and the workpiece 10. In some aspects, changing 320 the curvature C of the curved surfaces 71 and 81 of the first and second articulating assemblies 70 and 80 includes displacing the center plate 60 toward the mounting plate 50 against biasing mechanism 90 that urges the center plate 60 away from the mounting plate 50. In some aspects, changing 320 the curvature C of the curved surfaces 71 and 81 includes decreasing a radius of curvature R of the curved surfaces 71 and 81 of the first and second articulating assemblies 70 and 80.

The method further includes moving 330, while the curvature C of the curved surfaces 71 and 81 of the first and second articulating assemblies correspond to the curvature C' of the curved sections 14 of the workpiece 10, the abrading system 20 along the workpiece 10 along a longitudinal axis 18 of the workpiece 10 so as to abrade the exterior surface 12 of the workpiece 10. The movement of the abrading system 20 is in response to manually and/or machine applied force that acts to displace the mounting plate 50 of the frame 40 in the longitudinal direction. The moving 330 of the abrading system 20 along the longitudinal axis 18 of the workpiece 10, in some aspects, may be done in not more than a single pass along the longitudinal axis 18 of the workpiece 10, to achieve the desired abrasion. In some aspects, the moving 330 of the abrading system 20 along the longitudinal axis 18 of the workpiece 10 may be done in multiple passes along the longitudinal axis 18 of the workpiece 10, to achieve the desired abrasion.

In some aspects, the method 300 includes the optional step of attaching 310 a vibration source 24 to the mounting plate 50. In such an aspect, the moving 330 the abrading system 20 along a longitudinal axis 18 of the workpiece 10 includes vibrating the frame 40 using the vibration source 24 while moving the abrading system 20 along the workpiece 10. In some aspects, the vibration source 24 is an orbital sander.

In some aspects, the method 300 includes the optional step of replacing 340 the abrasion surface 34 by removing a first abrasion pad 30 from the frame 40 and attaching a second abrasion pad 30b to the frame 40 in place of the first abrasion pad 30.

In some embodiments, the links 72 and 82, mounting plate 50, and/or center plate 60 include stops 73 and 83 that limit the relative rotation between adjacent components. These stops 73 and 83, in some aspects, limit a minimum curvature of the first and second articulating assemblies 70 and 80, so that the distance D between the mounting plate 50 and center plate 60 remains below a predefined maximum distance when the center plate 60 is not being forced toward the mounting plate 50.

Advantageously, when the center plate 60 is not being urged toward the mounting plate 50 or vice versa, such as when the frame 40 is not in contact with the workpiece 10, at least portions of the intermediate links 74 and 84 of the links 72 and 82 of the respective first and second articulating assemblies 70 and 80 both extend below the center plate 60. This arrangement allows the frame 40 and/or an attached abrasion pad 30 to have some curvature prior to contact with the frame 40 and/or before the changing 320 the curvature C of the curved surfaces 71 and 81, which allows for efficient operation.

Thus, in some aspects, the links 72 and 82 of each of the first and second articulating assemblies 70 and 80 include respective stops 73 and 83 that limit relative rotation of adjacent links 72 and 82 so that: a) distance D between the mounting plate 50 and the center plate 60 remains below a predefined maximum distance when the center plate 60 is not being forced toward the mounting plate 50; b) a first intermediate link 74 of the plurality of links 72 of the first articulating assembly 70 extends below the center plate 60; and c) a second intermediate link 84 of the plurality of links 82 of the second articulating assembly 80 extends below the center plate 60. Similarly, in some aspects, the abrading system 20 is configured such that the abrasion surface 34 is curved downwardly convex with the center plate 60 and the mounting plate not urged toward each other, and changing 320 the curvature C 300 includes decreasing the radius of curvature R of the curved surfaces 71 and 81 of the first and second articulating assemblies 70 and 80 (respectively).

The frame 40 may be made from any suitable materials. For example, the mounting plate 50, center plate 60, and links 72 and 82 of the first and second articulating assemblies 70 and 80 may be plastic or metal. The abrasion pad 30 may be made from any suitable material(s), with the abrasion surface 34 being formed of a material suitable for abrading the workpiece 10. Thus, abrasion surface 34 may be tailored to the material characteristics of the workpiece 10 and/or the desired surface abrasion.

Further aspects of the present disclosure contemplate the use of the frame 40 and/or the abrading system 20 to manufacture structural and other components. For example, the structural and other components can be for use with vehicles including, without limitation, aircraft (e.g. spars, ribs, stringers, etc.). Vehicles further include, without limitation, manned aircraft, an unmanned aircraft, a manned spacecraft, an unmanned spacecraft, a manned rotorcraft, an unmanned rotorcraft, a satellite, a rocket, a missile, a manned terrestrial vehicle, an unmanned terrestrial vehicle, a manned surface water borne vehicle, an unmanned surface water borne vehicle, a manned sub-surface water borne vehicle, an unmanned sub-surface water borne vehicle, and combinations thereof. In other examples, the structural or other components may be used in buildings, bridges, walkways, sculptures, enclosures, and combinations thereof.

The present disclosure may, of course, be carried out in other ways than those specifically set forth herein without departing from essential characteristics of the disclosure. The present embodiments are to be considered in all respects as illustrative and not restrictive, and all changes coming within the meaning and equivalency range of the appended claims are intended to be embraced therein.

What is claimed is:

1. A frame for an abrading system configured to abrade an exterior surface of a workpiece, at least a portion of the exterior surface being a curved section having a curvature, the frame comprising:

a mounting plate having a first end portion and a second end portion opposite the first end portion;

a center plate having a first end portion and a second end portion opposite the first end portion;

a first articulating assembly coupled to the mounting plate first end portion and the center plate first end portion, the first articulating assembly defining a first curved surface; and a second articulating assembly coupled to the mounting plate second end portion and the center plate second end portion, the second articulating assembly defining a second curved surface;

wherein each of the first and second articulating assemblies are configured to change a curvature of their respective curved surfaces to correspond to the curvature of the curved section of the workpiece, in response to relative displacement of the center plate toward the mounting plate.

2. The frame of claim 1, further comprising a biasing mechanism coupled to the mounting plate and the center plate and configured to bias the mounting plate and the center plate apart.

3. The frame of claim 2, wherein the biasing mechanism comprises a plurality of biasing posts that inhibit relative lateral movement between the mounting plate and the center plate.

4. The frame of claim 3, wherein each biasing post comprises first member, a second member positioned at least partially within the first member, and a spring housed within the first member and the second member.

5. The frame of claim 1:

wherein the first and second end portions of the mounting plate are downwardly extending;

wherein the mounting plate further comprises a central zone disposed between the first and second end portions;

wherein the first articulating assembly connects to the mounting plate at the first end portion of the mounting plate; and wherein the second articulating assembly connects to the mounting plate at the second end portion of the mounting plate.

6. The frame of claim 5, wherein the mounting plate circumscribes an arc of at least 180° from a distal tip of the first end portion to a distal tip of the second end portion.

7. The frame of claim 1, wherein each of the first and second articulating assemblies comprises a plurality of links hinged together in series; wherein each of the plurality of links is rigid.

8. The frame of claim 7:

wherein adjacent ones of the links of the first articulating assembly are pivotally interconnected for relative rotation about a corresponding pivot axis; and wherein adjacent ones of the links of the second articulating assembly are pivotally interconnected for relative rotation about a corresponding pivot axis.

9. The frame of claim 7, wherein the links of each of the first and second articulating assemblies include respective stops that limit relative rotation of adjacent links so that:

a distance between the mounting plate and the center plate remains below a predefined maximum distance when the center plate is not being forced toward the mounting plate;

a first intermediate link of the plurality of links of the first articulating assembly extends below the center plate; and a second intermediate link of the plurality of links of the second articulating assembly extends below the center plate.

10. The frame of claim 7:

wherein the first articulating assembly comprises a first intermediate link; wherein the first intermediate link is non-linear; wherein the first intermediate link comprises a first portion and a second portion that extends transversely to the first portion; and wherein the second articulating assembly comprises a second intermediate link; wherein the second intermediate link is non-linear; wherein the second intermediate link comprises a first portion and a second portion that extends at transversely to the first portion.

11. The frame of claim 1, wherein the center plate is planar.

12. A method of abrading an exterior surface of a workpiece using an abrading system, at least a portion of the exterior surface being a curved section having a curvature, the abrading system including a frame and a first abrasion pad coupled to the frame, the first abrasion pad having an abrasion surface, the frame comprising: a mounting plate having a first end portion and a second end portion opposite the first end portion; a center plate having a first end portion and a second end portion opposite the first end portion; a first articulating assembly coupled to the mounting plate first end portion and the center plate first end portion, the first articulating assembly defining a first curved surface; a second articulating assembly coupled to the mounting plate second end portion and the center plate second end portion, the second articulating assembly defining a second curved surface; wherein the first abrasion pad is mounted to the center plate and at least part of each of the first and second curved surfaces of the first and second articulating assemblies so that the abrasion surface of the first abrasion pad faces away from the mounting plate, the method comprising:

changing a curvature of the curved surfaces of the first and second articulating assemblies to correspond to the curvature of the curved section of the workpiece by pressing the abrasion surface against the workpiece so as to displace the mounting plate toward the center plate; and moving, while the curvature of the curved surfaces of the first and second articulating assemblies correspond to the curvature of the curved section of the workpiece, the abrading system along the workpiece along a longitudinal axis of the workpiece so as to abrade the exterior surface of the workpiece.

13. The method of claim 12:

further comprising attaching a vibration source to the mounting plate; and wherein the moving the abrading system along the along a longitudinal axis 18 of the workpiece comprises vibrating the frame using the vibration source while moving the abrading system along the workpiece.

14. The method of claim 12:

wherein the abrasion surface is curved downwardly convex with the center plate and mounting plate not urged toward each other; and wherein the changing the curvature comprises decreasing a radius of curvature of the curved surfaces of the first and second articulating assemblies.

15. The method of claim 12, wherein the changing the curvature comprises displacing the center plate toward the mounting plate against a biasing mechanism that urges the center plate away from the mounting plate.

16. The method of claim 12, further comprising replacing the abrasion surface by removing the first abrasion pad from the frame and attaching a second abrasion pad to the frame in place of the first abrasion pad.

17. An abrading system for abrading a surface of a workpiece, at least a portion of the surface being a curved section having a curvature, the abrading system comprising:

an abrasion pad having a first surface and an opposite abrasion surface; and a frame, the frame comprising:

a mounting plate having a first end portion and a second end portion opposite the first end portion;

a center plate having a first end portion and a second end portion opposite the first end portion;

a first articulating assembly coupled to the mounting plate first end portion and the center plate first end portion, the first articulating assembly defining a first curved surface; and a second articulating assembly coupled to the mounting plate second end portion and the center plate second end portion, the second articulating assembly defining a second curved surface;

wherein each of the first and second articulating assemblies are configured to change a curvature of their respective curved surfaces to correspond to the curvature of the curved section of the workpiece, in response to relative displacement of the center plate toward the mounting plate;

wherein the first surface of the abrasion pad is mounted to the center plate and the first and second curved surfaces.

18. The abrading system of claim 17, further comprising a vibration source operatively coupled to the mounting plate.

19. The abrading system of claim 18, wherein the vibration source is an orbital sander.

20. The abrading system of claim 17, wherein the frame further comprises a biasing mechanism coupled to the mounting plate and the center plate and configured to bias the mounting plate and the center plate apart.

* * * * *